United States Patent [19]

Smith

[11] 4,259,924

[45] Apr. 7, 1981

[54] DEVICE FOR COATING PAPER

[76] Inventor: Robert C. Smith, 8862 U.S. Rte. 42, Florence, Ky. 41042

[21] Appl. No.: 877,307

[22] Filed: Feb. 13, 1978

[51] Int. Cl.[3] ..... C23C 13/08

[52] U.S. Cl. ..... 118/706; 118/50; 118/59; 118/68; 118/69; 118/101; 118/123; 118/302; 118/313; 118/314; 118/323; 118/324; 118/325; 118/500

[58] Field of Search ..... 118/50, 69, 302, 313-315, 118/323-324, 706, 59, 68, 101, 123, 325, 500

[56] References Cited

U.S. PATENT DOCUMENTS

| | | | |
|---|---|---|---|
| 2,832,309 | 4/1958 | Billson et al. | 118/500 X |
| 3,343,981 | 9/1967 | Lenkei | 118/315 X |
| 4,031,854 | 6/1977 | Sprague | 118/302 X |
| 4,045,598 | 8/1977 | Henson | 118/50 |
| 4,102,301 | 7/1978 | Reade et al. | 118/69 X |

*Primary Examiner*—Bernard D. Pianalto
*Attorney, Agent, or Firm*—Edward J. Utz

[57] ABSTRACT

This invention relates to a device for coating paper with a resin in a pattern to increase the tear strength of the paper by using an applicator head, rotatable about a shaft through which the resin material is passed through nozzles on to the paper. The resin material is supplied at a constant rate and at a constant temperature and pressure to paper moving at a predetermined speed.

4 Claims, 9 Drawing Figures

10
11
12
13
37
60
61
18
17
19
21
22
23
20
200
102
87
202

DEVICE FOR COATING PAPER

My invention relates to a device for manufacturing paper products in which the paper coating material is equally distributed. In particular, my invention relates to a manifold having applicator heads which equally distribute material. In particular, in my invention I have developed a process of coating with good adherency to paper bags with poly-propyline or other similar plastic resins available. In the invention wherein the poly-propyline is applied to the paper, I employ an extruder, a pump, a manifold, shut-off valves, applicator units, nozzles, chill rolls and a dryer-blower system. The extruder supplies the poly-propyline to the manifold system through the use of a pump. The manifold system equally distributes the material to each of the applicator units. The applicator units consist of rotating heads with stationary heaters from which the material is equally distributed.

The purpose of each applicator is to distribute a continuous path of material through nozzles to the paper being coated, creating a swirl pattern. Specifically, in my invention the output per (1) nozzle volume of material is 0.043 in.$^3$ per second per nozzle with a calculated pressure at the orifice of the nozzle to be 5 to 7 psi. The material is encompassed by a 0.500 diameter × 11" electrically heated element to raise or maintain the material temperature to approximately 550° F. After the material has moved approximately 11", the material enters into six (6) 0.125 diameter holes, spaced at 60° apart to maintain the final flow to the nozzle. The purpose of each nozzle is to maintain a constant flow pattern of material. The increase or decrease of material to the paper shall be controlled by the pump motor speed change that will vary the volumes necessary for a square inch cross-section of coating.

The principal object of my invention is to provide a method of coating paper such as kraft paper which will result in added tear strength to the paper.

Another object of my invention is to provide a method of coating paper using a system of nozzles whereby the material is evenly applied to the paper, which is later formed into bags for commercial use.

Another object of my invention is to provide a means for distributing coating material to paper with chilling rolls to cool the paper and finally a cool air-blower system to chill the coating before the paper enters the bag-making machinery.

In general, I provide a paper roll from which paper is fed to an applicator through feed rolls. One of the feed rolls is chrome-satin plated, and the other is rubber coated. The paper is pulled through the applicator unit by squeeze rolls which duplicate the action of the feed rolls. The paper is moved through chill rolls so that the temperature of the coated product is reduced by 50% of the coating temperature. After leaving the chill rolls, the product is again slightly cooled by a series of blowers and is then fed into a bag making machine. The applicator unit assembly consists of a frame, rotating heads, drive mechanism, a platen with vacuum plates and a series of nozzles. The rotating movement of the coating material and the movement of the paper results in a combined configuration of a swirl design. However, it is obvious to those skilled in the art that the positioning of the nozzles and the various speeds of the paper will determine the final design of the coated product. Specifically, the invention uses a resin on kraft paper to provide additional tear strength and to serve as a moisture repellent. I have found by experimentation that 40-pound kraft paper supplied with the swirl coating through my invention exceeds the tear strength of 70-pound kraft paper. Specifically, through the applicator units, we provide a resin flow in a totally closed system and heating units are placed in the system to insure constant temperature from the extruder to the nozzles and onto the paper. We do not have degradation within the unit since a continuous closed system flow shall be maintained in operation. In addition to added tear strength to the paper and the low moisture absorbtion, the paper is not subject to environmental stress cracking and the shrinkage is minimal.

Referring now to the detailed description of the invention, I show in the drawings.

The sectional views are taken looking in the direction of the arrows at the ends of the section lines and the same reference numerals refer to similar parts throughout the several views.

Figure 2:
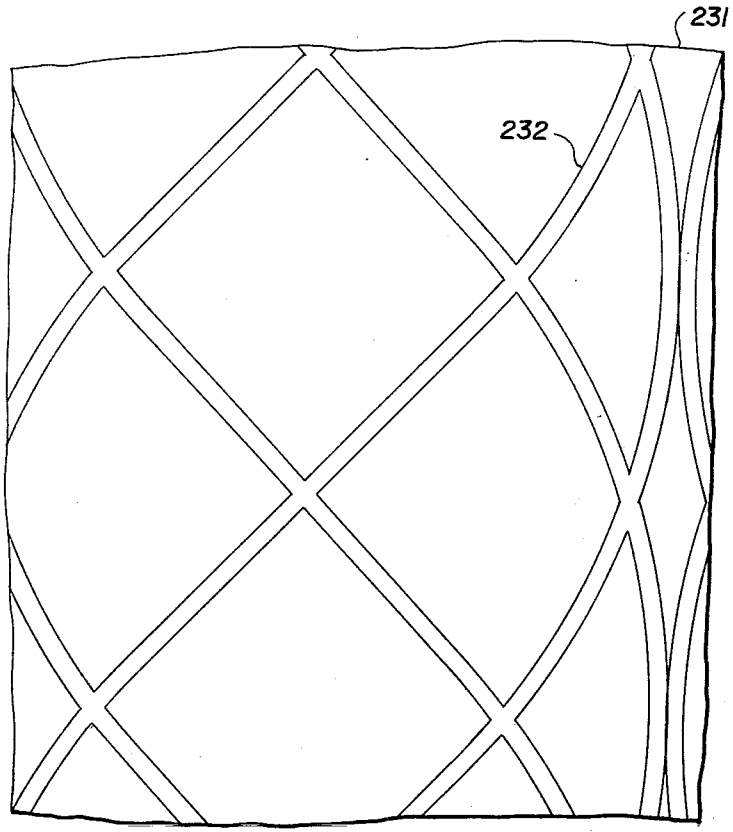
FIG. 2 is an enlarged section of a portion of the product shown in FIG. 1.
Figures 3, 5:
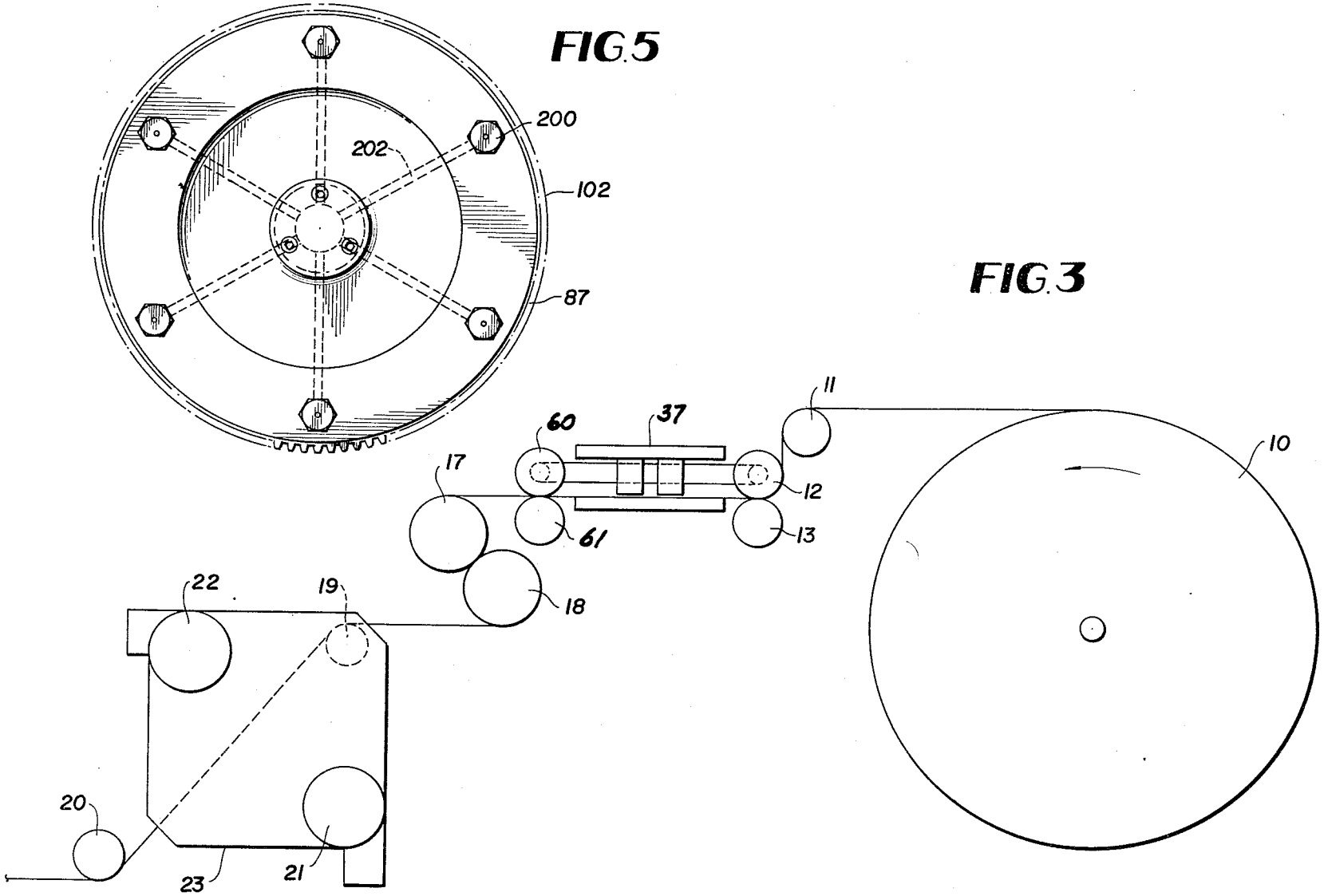
FIG. 3 is a schematic view of the process of the invention.
FIG. 5 is a sectional view taken along line 5—5 of FIG. 4.

In FIG. 3, the paper is fed from roll 10 over idler roll 11 to the applicator unit assembly 37 by feed rolls 12 and 13. Roll 12 is chrome-satin plated and roll 13 is rubber coated. The paper is pulled through the applicator unit 37 by squeeze rolls 60 and 61, which rolls rotate at the same speed and direction as rolls 12 and 13. Roll 60 is chrome plated satin finish and roll 61 is rubber coated. Rolls 17 and 18 are termed chill rolls and chill the coating material (to be described later) to 250° F. Each chill roll is designed so that the material contacts three-fourths of the outside diameter of the roll. This is necessary to reduce the temperature of the coated product by about 50% of coated temperatures. Feed rubber roll 13 is adjusted vertically by pressure from piston rod 67 and cylinder 30 through sliding pillow block 28 carried on shaft 29 shown on FIG. 7, to pressurize roll 12 to pull paper. Squeeze roll 61 is adjusted vertically by rod 66, cylinder 31 and pillow block 64 carried on shaft 65. Cylinder rod 66 and cylinder 31 apply pressure to rubber coated squeeze roll 61 to pressurize chrome plated roll 60. A stationary pillow block 62 carries shaft 63 of squeeze roll 60. A stationary pillow block 24 carries shaft 25 and feed roll 12. The squeezing between rolls 60 and 61 helps material to penetrate the paper and to flatten pattern 232 shown in FIG. 2.

The product, after leaving the chill rolls 17 and 18 (refer to FIG. 3) is subsequently slightly cooled to eliminate any tacky condition of coating by a series of blowers indicated at 21 and 22 in an enclosed chamber 23 which houses idlers 19 and 20.

Referring to FIG. 3, both sides of the paper are chilled by chill rolls 17 and 18, the underside of paper by chill roll 17, and the coated side by chill roll 18.

Figures 7, 9:
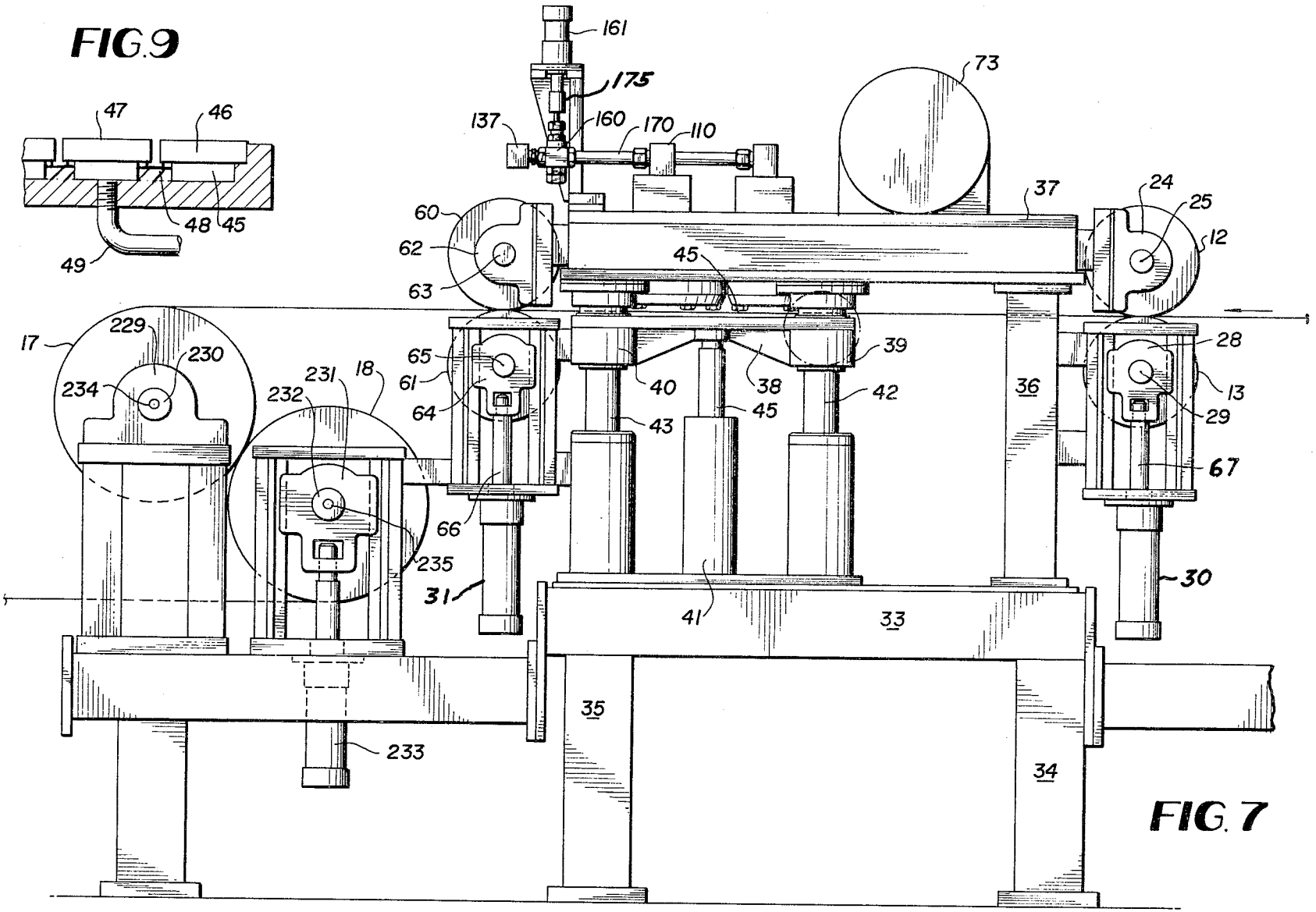
FIG. 7 is a view in side elevation of the invention.
FIG. 9 is a detailed sectional view showing the vacuum plates.

Referring to FIG. 7, chill roll 17 is chrome plated, being solid mounted by pillow blocks 229 on roll axle 234. Rotary joint 230 threaded into axle 234 shall supply community water to roll for coolant and return. Chill roll 18 is chrome plated, being adjustable vertically by moveable pillow block 231 on axle 232 support within frame structure. Rotary joint connector with flexible hose indicated at 235 threaded into axle 232 supplies community water to roll 18 for coolant and return.

Referring to FIG. 7, the polyswirl applicator assembly is secured to a frame such as 33 which has a pair of legs, such as 34 and 35 of welded construction and an end vertical member 36 and a top carrying applicator unit sub-assembly 37. Note that 36 is a support member, one on each side, only one of which is shown in FIG. 7. In FIG. 7, I also show a moveable platen indicated generally at 38 which is supported by linear bearings such as 39 and 40 and support rods such as 42 and 43 which also support the applicator unit 37 and is moveable vertically by means of an air cylinder having a piston 45, to allow predetermined paper distance between nozzles 200 and the paper running on platen 38 and plates 46 and 47.

FIG. 9 is an enlarged detailed view of a portion of a platen 38. The platen 38 houses a series of vacuum ground plates, such as 46 and 47 in a fixed position supported on the platen 38. The platen 38 has recessed or vacuum cavity portion 48 for securing the plates 46 and 47 and a vacuum is produced within the recessed portion 45 by means of a vacuum pump (not shown) connected by a hose 49 to the recessed portion 45. The spacing or gap between the plates 46 and 47 are adjustable to regulate the vacuum suction at the bottom side of the paper for coating penetration between the paper fibers.

Figure 6:
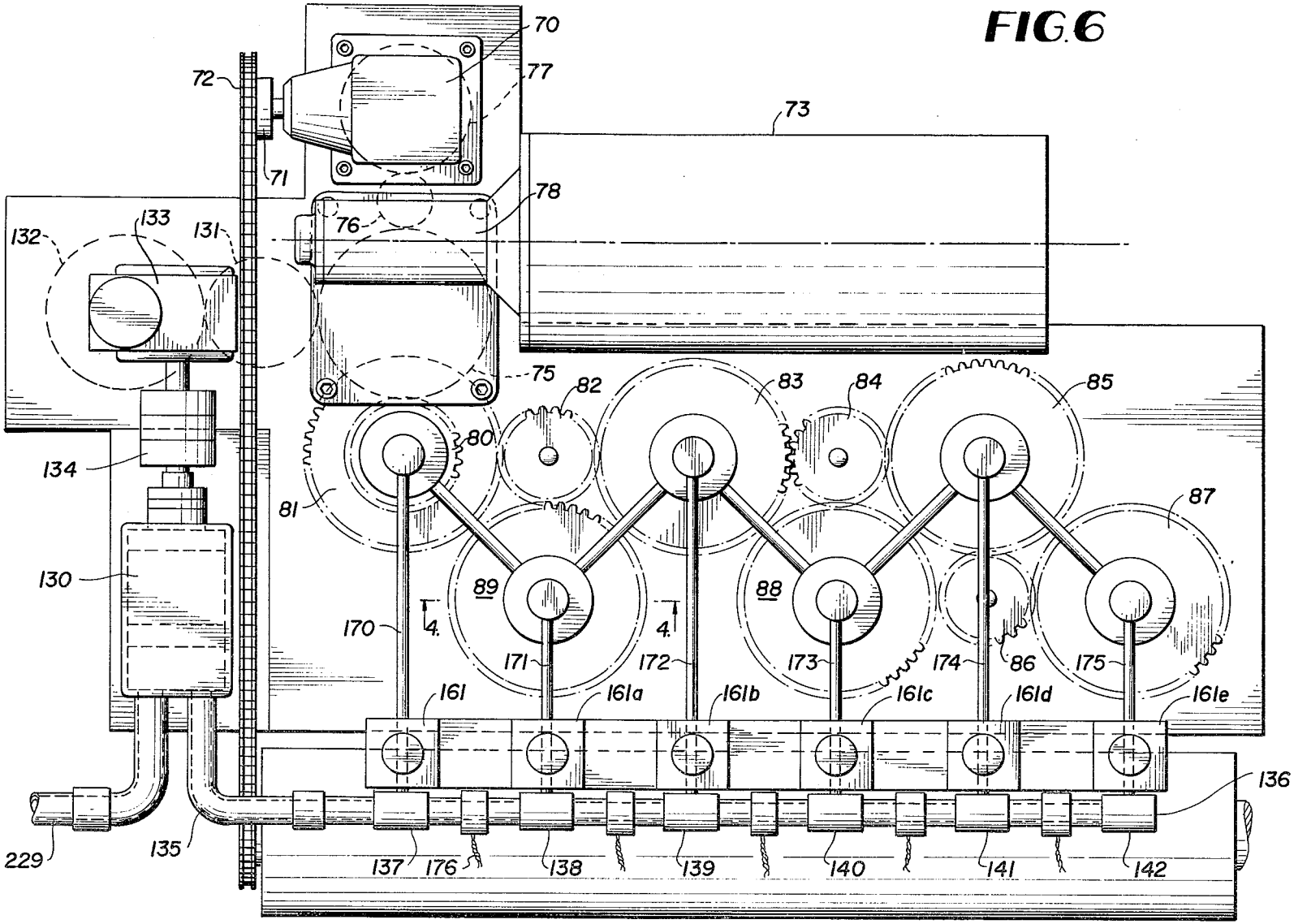
FIG. 6 is a plan view of the applicator.

Referring to FIG. 6, the applicator drive motor 73 uses slave power and shall be controlled by the main motor of a bag machine (not shown). Each bag machine motor shall use a controller to electronically govern the supply power to the applicator drive motor 73 to control the exact F.P.M. between the two units. The motor 73 drives a 5:1 ratio reducing unit 78 which drives a bull gear 75, which drives gear 80, which drives reduction gear 81, which drives idler gear 82, which drives gear 83, which drives idler gear 84, which drives gear 85, which drives idler gear 86, which drives gear 87. Idler gear 84 drives gear 88. Idler gear 82 also drives gear 89.

The bull gear 75 drives idler gear 76 and gear 77 to drive the 1:1 ratio reduction unit 70 which drives sprocket 71 to drive sprocket chain 72 which drives feed roll 12 (FIG. 7). The bull gear 75 drives idler gear 131, which drives gear 132 and the 10:1 ratio reducer 133 through a coupling 134 to a geared pump 130.

The purpose of the synchronization provided by the gear reduction unit 70 through the sprocket 71 and chain 72 is to synchronize the paper speed and to allow the work distance between rolls 60, 61, and 12, 13 as a transport area with a near zero tension. The gears described above are driven by the bull gear 75 for synchronizing at a selected paper speed and bag making production.

Referring again to FIG. 4, I provide ring heaters such as 101 secured to the lower part of the housing cap 100 which is provided on the inside upper portion with insulation material 102 to retain the heat and to force the heat direction downward to the rotating head 102. The rotating head 102 is rotated about a shaft 103 and is secured thereto by means of a slip fit at 104. A spring 105 applies pressure to seal 107 with a 45 degree cavity while securing the center rod 103 during rotation. The spring applies opposing loads to face seals 107, 112, 116 and 115 and bearing 107. An upper cap member 110 is secured to the housing 90 by means of screw 111. I provide a face seal 112 between shaft 103 and cap member 110 which seals the escapement of coating material.

Figure 4:
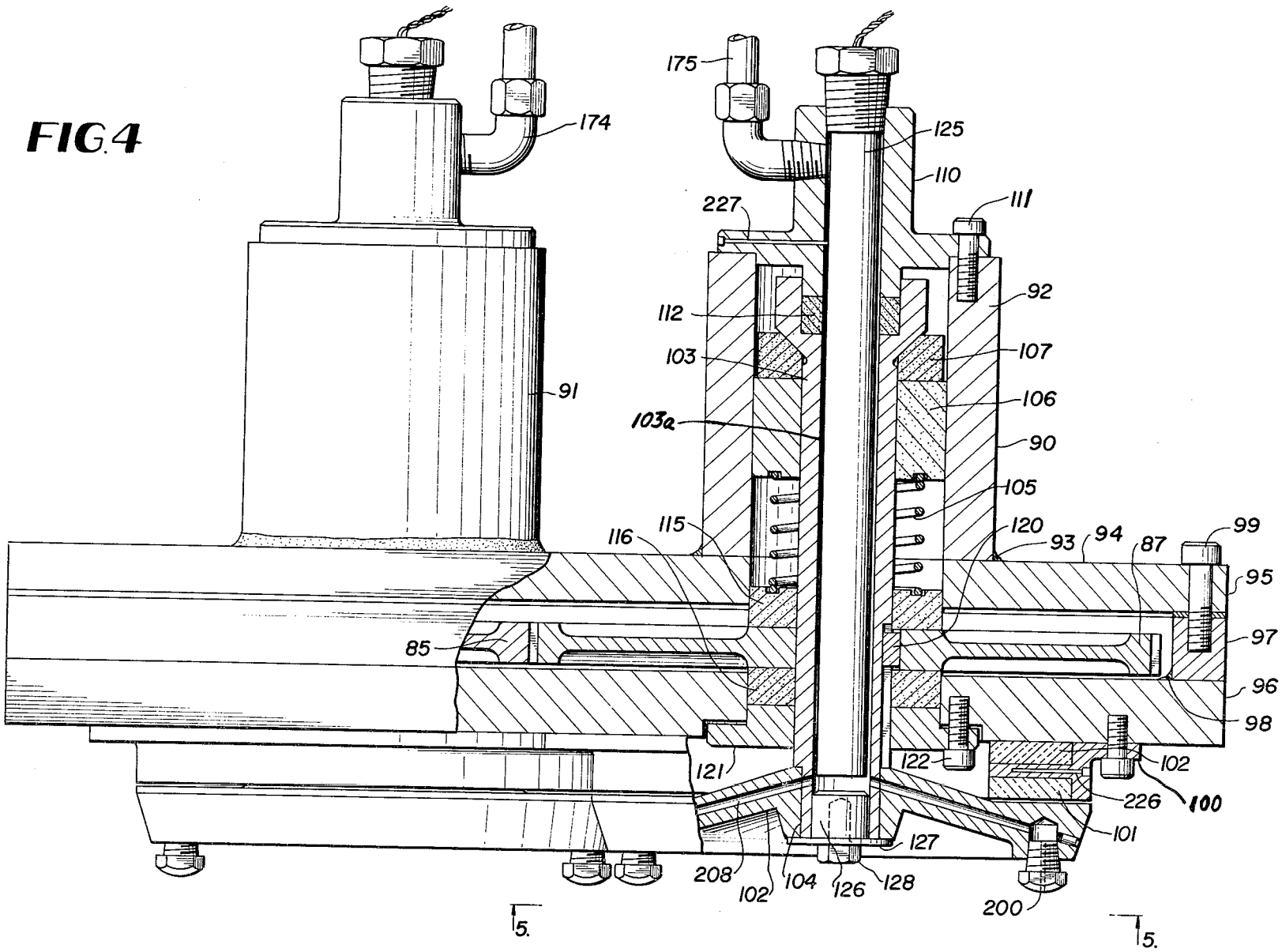
FIG. 4 is a section of an applicator taken along line 4—4 of FIG. 6.

Gears 85 and 87 which are shown in detail in FIG. 4 drive the center shaft 103 through a key 120. Face seals 115 and 116 are provided to stabilize the gear 87 or gear 85 to provide a bearing for the upper and lower sections of the gear 87 or 85. A cap 121 is secured by means of a bolt 122 to the housing 96.

I provide a ring heater adapter 100 which houses a heater 101 and an insulator 102 secured to lower member 96 (part of assembly 37 shown in FIG. 7). Member 90 is welded to plate 94 at weld 93, and secured also by screws such as 99 threaded securely to spacer 97 welded to member 96 by weld 98. Insulating gaskets, tubing covers, and seal rings are provided where needed to seal assemblies (gaskets and seals are not shown).

Heating element 125 is secured by its threaded end to cap 110 which is secured to member by bolts such as 111. A thermocouple 227 is threadedly positioned in cap 110 to continuously measure the temperature of heating element 125. The temperature of the heating element 125 is preferably maintained at a temperature less than 550° F. The thermocouple 227 is connected to a control panel 225 by co-axial cables which control temperature of heating assembly 125 (not shown). Thermocouple 226 measures the temperature of heat ring 101 and the temperature should not exceed 550° F. Thermocouple 226 is connected by co-axial cables to instruments that are located in the control panel 225 that control temperature of each heating element 226. Insulated tubing and fitting assembly 175 feeds heated coated material around heating element 125 within the center shaft 103 to head 102 to nozzle 200.

I maintain a constant flow velocity from the manifold assembly 136 through the tubing 175 through holes 208 to nozzles 200 which are pressurized.

I provide a heating means so that the coating material is at 550° F. while the unit is in operation or at a non-operable phase. The rotating head 102 (FIG. 4) is secured to the shaft 103 by means of a plug 126, which is press fitted into shaft 103. The head 102 is slip fitted to shaft 103 at 104 and secured by washer 127 and bolt 128.

Referring to FIG. 6, I provide a pump which is driven by means through an idler gear 131 and drive gear 132 through a 10:1 gear reduction 133. A coupling 134 is provided to drive the pump and isolates the heat transfer to the gearing. The pump 130 has connected thereto a pipe 135 which supplies a manifold assembly 136 provided with a series of tee ported transition devices 137, 138, 139, 140, 141 and 142 which supply material to tubing assemblies 170, 171, 172, 173, 174 and 175 which supplies the applicator heads or cap 110 shown in FIG. 4

Figure 8:
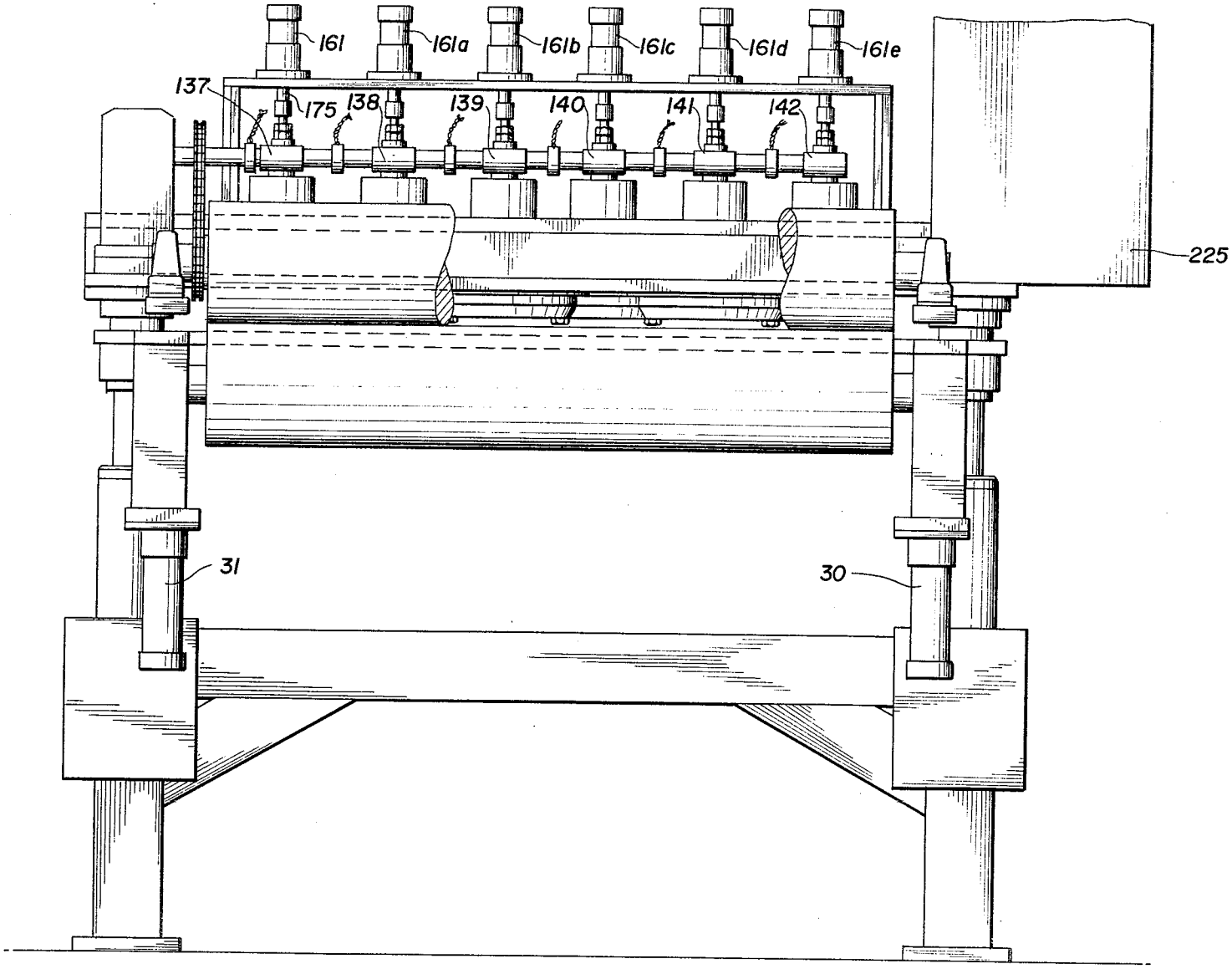
FIG. 8 is a view in end elevation of the machine of my invention.

In FIG. 7, I show a tee ported transition device 137 connected to a spring loaded shut-off valve 160 which is operable automatically by an air cylinder 161. The purpose of the shut-off valve and air cylinder 161 is to provide for pressure and flow shut-off of the line within the system in the event of a power shut-down or maintenance and to control the storage pressure in the manifold indicated generally at manifold assembly 136 through tee ported transition devices 137, 138, 139, 140, 141 and 142 at a constant pressure of 400 psi. When the shut-off valve 160 is in closed position the pressure at nozzle 200 becomes zero allowing no drips or leakage to the paper or to the machine. The material is fed to the top of the applicator such as cap 110 when operating (see FIG. 4). The material is also fed through tubing such as indicated in FIG. 6 at 170, 171, 172, 173, 174 and 175. In the preferred embodiment, I show six applicators. Each of the shut-off valve cylinders 161, 161*a*, 161*b*, 161*c*, 161*d*, and 161*e* is provided with a typical heat insulator such as 175 which insulates the heat exchange between the air cylinder and the valve 160 (FIG. 8).

Figure 1:
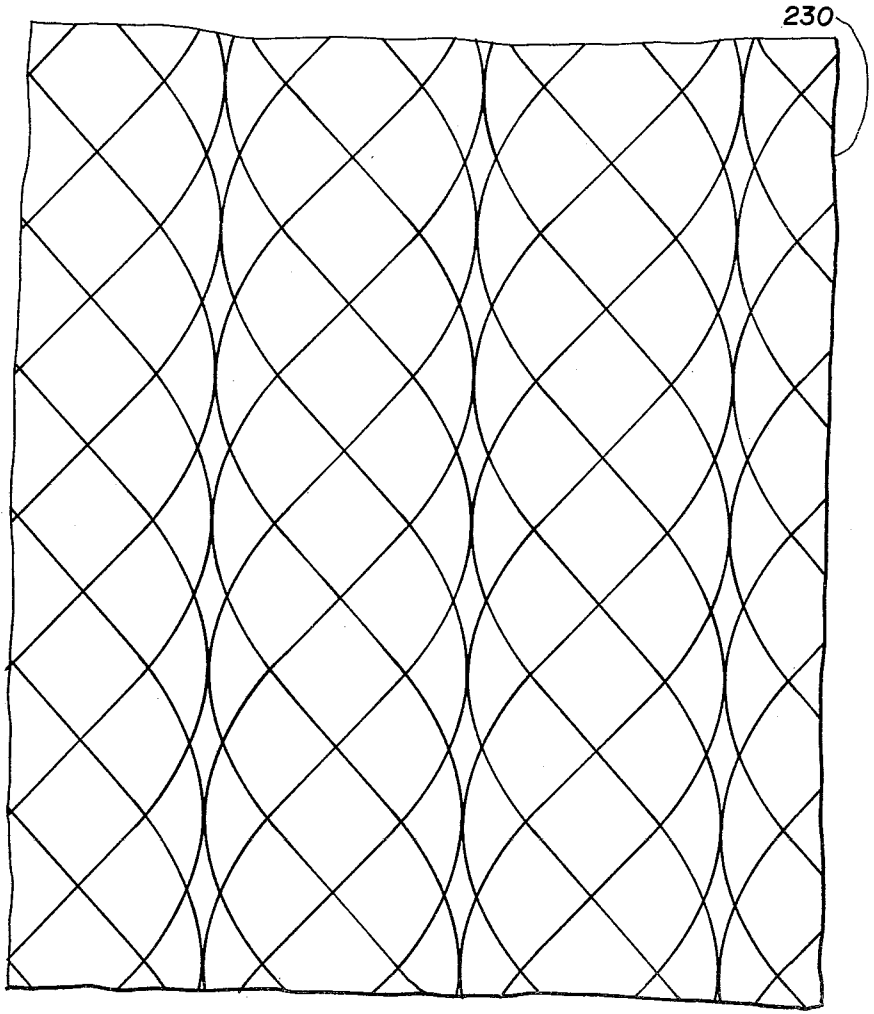
FIG. 1 is a section of the finished product.

Referring again to FIG. 6, I show a series of ring heaters such as 176 to heat the manifold to 550° F. Each ring heater 176 maintains a constant temperature with associated thermostat control attached to the manifold. The total functions mentioned regarding the heads 102 in FIG. 4 create 36 swirl paths, 232 to the paper, 231 as is indicated in the product samples 230 shown in FIGS. 1 and 2.

In FIG. 6, I show a coating feed line 229 to supply material to the geared pump. The feed line 229 originates with a commercially available 3½" extruder that processes and supplies the coating material at a controlled temperature between 500° to 550° F. The extruder is not shown and may be mounted as an attached unit above the applicator assembly as shown at 37 in FIG. 7.

Having thus described my invention, what I claim as new and useful and desire to secure by U.S. Letters Patent is:

1. A device for coating paper with a resin of the polypropylene class comprising the combination of a pair of pressure rolls through which paper is drawn, an applicator through which resin is applied to the paper to be coated, a pair of chill rolls through which the resin coated paper is passed, said applicator having a series of rotating heads to which nozzles are secured, heating means in said applicator through which said resin is passed, said material heated to a range of 500°–550° F., gear means for rotating said rotating heads at a constant speed, a pump for supplying constant pressure to said rotating heads to secure the even application of resin to paper which is passed under said heads and vacuum means secured to the underside of said device for securing said paper while said paper is resin coated.

2. A device for coating paper with a resin of the polypropylene class comprising the combination of a pair of rolls through which paper is passed, means for applying the resin coating to said paper consisting of an applicator through which pre-heated resin coating is passed, said applicator having a series of spaced rotating heads from which the resin coating is applied to the paper at constant temperature of the order of 500° to 550° F., pump means for controling the application of said resin coating, a pair of squeeze rolls and a pair of chill rolls, to chill the paper after the resin coating has been applied.

3. A device for applying a resin of the polypropylene class substance to paper comprising an applicator unit, a triple pair of rolls, one pair of said rolls positioned so that the paper must pass between said rolls prior to its exposure to the applicator; a second pair of rolls positioned so that the coated paper is passed therethrough, a third pair of rolls through which said paper is passed and chilled, said rolls syncronized to present a constant paper surface to said applicator, said applicator comprising a plurality of gear driven rotatable heads, a heater connected to each of said heads, around which the resin to be applied to the paper is passed, said heater heating said resin to a 500°–550° F. temperature, a plurality of nozzles equally spaced on each of said rotatable heads, a column containing said heater in each of said heads and each of columns connected by a passageway to each of said nozzles, a pump connected to each of said columns, and gear mechanism syncronizing the speed of said pump with the speed of rotation of said rotatable heads to supply resin coating to said paper passing under said applicator from said plurality of nozzles at a constant pressure.

4. The device of claim 3 wherein the applicator is secured over a platen, said platen having a cavity portion, and vacuum means connected to said cavity in said platen to suction the resin coating materials into the paper fibers.

* * * * *